US005928092A

United States Patent [19]

Keeter et al.

[11] Patent Number: 5,928,092

[45] Date of Patent: Jul. 27, 1999

[54] BATTING TEE FOR BASEBALL AND SOFTBALL

[76] Inventors: Lonnie William Keeter, 18803 Chapae La., Apple Valley, Calif. 92307; Tom Freden, 15439 Pawney Ridge, Victorville, Calif. 92394

[21] Appl. No.: 09/002,713

[22] Filed: Jan. 2, 1998

Related U.S. Application Data

[51] Int. Cl.[6] ..... A63B 69/40

[52] U.S. Cl. ..... 473/417

[58] Field of Search ..... 473/417, 422, 473/453, 451, FOR 103

[56] References Cited

U.S. PATENT DOCUMENTS

| | | | |
|---|---|---|---|
| 3,139,282 | 6/1964 | Lande | 473/417 |
| 4,456,250 | 6/1984 | Perrone, Jr. | 473/417 |
| 5,004,234 | 4/1991 | Hollis | 473/417 |
| 5,100,134 | 3/1992 | Becker | 473/417 |
| 5,320,343 | 6/1994 | McKinney | 473/417 |
| 5,386,987 | 2/1995 | Rodino, Jr. | 473/417 |
| 5,388,823 | 2/1995 | Prieto | 473/417 |
| 5,556,091 | 9/1996 | Lin | 473/417 |
| 5,580,047 | 12/1996 | Shih et al. | 473/417 |
| 5,595,384 | 1/1997 | Hardison, Jr. | 473/417 X |
| 5,662,536 | 9/1997 | Martinez | 473/417 |

OTHER PUBLICATIONS

"How to Make a Batting Tee", Popular Science, p. 183, Mar. 1959.

Print AD—Baseball Express, admitted prior art.

Print AD—Inside–Outside Tee, admitted prior art.

*Primary Examiner*—Raleigh W. Chiu

*Attorney, Agent, or Firm*—Gene Scott-Patent Law & Venture Group

[57] ABSTRACT

The present invention provides a baseball support device for holding a baseball in position for batting practice. The device has a base shaped like home plate. A first support strut is engagable with an engagement lip on the base such that the first support strut extends upwardly in a vertical attitude. A swing arm assembly, having a second support strut and a third support strut connected by an integral horizontal arm, is rotatably engaged with the first support strut, either by the second or third support strut. The horizontal arm terminates with a ball holder at either end. The base includes a handle and an three battery type clips for holding the first support strut and the swing arm assembly when the invention is disassembled for travel or storage.

5 Claims, 3 Drawing Sheets

BATTING TEE FOR BASEBALL AND SOFTBALL

BACKGROUND OF THE INVENTION

1. Field of the Invention

This invention relates generally to baseball training equipment, and more particularly to a baseball support device for holding a baseball in position for batting training and practice.

2. Description of Related Art

Baseball batting practice devices of various types are well known in the art. The simplest devices are stands having a resilient support member which can support a baseball. The batter simply places a baseball on the resilient support member and hits the ball off the support member. While these simple, usually home-made devices are useful for novice batters, they are of little value to more experienced players.

More professional batting practice and training devices are known. One device that is relevant to the present invention is the ATEC Batting Tee distributed by Baseball Express™. This device provides a stand base having the shape of a regulation home-plate, and a series of upwardly open sockets integral with the base. One or more telescoping tubes may be placed in any one or more of the sockets for supporting baseballs for practice. In this device position and elevation are adjustable within certain limits. A further device is the Inside-Outside Tee™ which is commercially available. In this device a home-plate shaped base supports two horizontal pivoted arms, each in turn holding an upwardly extending and telescoping tube upon which a ball may be placed.

Other batting practice devices pitch the ball to the user so he can hit the ball in the air. However, this equipment is not only expensive, it also does not fill a need for early training of the beginner.

The prior art teaches baseball batting practice devices of various types. However, the prior art does not teach a baseball batting practice device which is inexpensive, highly portable, rugged, easy to assemble and use, and capable of teaching basic swing techniques to the beginner. The present invention fulfills these needs and provides further related advantages as described in the following summary.

SUMMARY OF THE INVENTION

The present invention teaches certain benefits in construction and use which give rise to the objectives described below.

The present invention provides a baseball support device for holding a baseball in certain important positions for batting training and practice. The device has a support base shaped like a baseball home-plate. A first support strut is engagable with a series of engagement lips on the support base such that the first support strut extends upwardly in a vertical attitude when it is properly fitted on the support base. A swing arm assembly having a second support strut, a third support strut, and a horizontal arm is rotatably engaged with the first support strut, by either engaging the second or third support strut with the first support strut. The horizontal arm terminates with a ball holding means at either end. The support base includes a handle and a series of clamps for holding the first support strut and the swing arm assembly when the invention is disassembled for travel or storage.

A primary objective of the present invention is to provide a baseball support device for holding a baseball in various and adjustable positions for batting training and practice, the baseball support device having advantages not taught by the prior art.

Another objective is to provide an easily adjustable baseball support device which can support two baseballs in a spaced apart orientation for teaching various special batting skills to improve the technical skills of experienced batters.

A further objective is to provide a baseball support device which can be compactly reconfigured for ease in carrying and storage.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
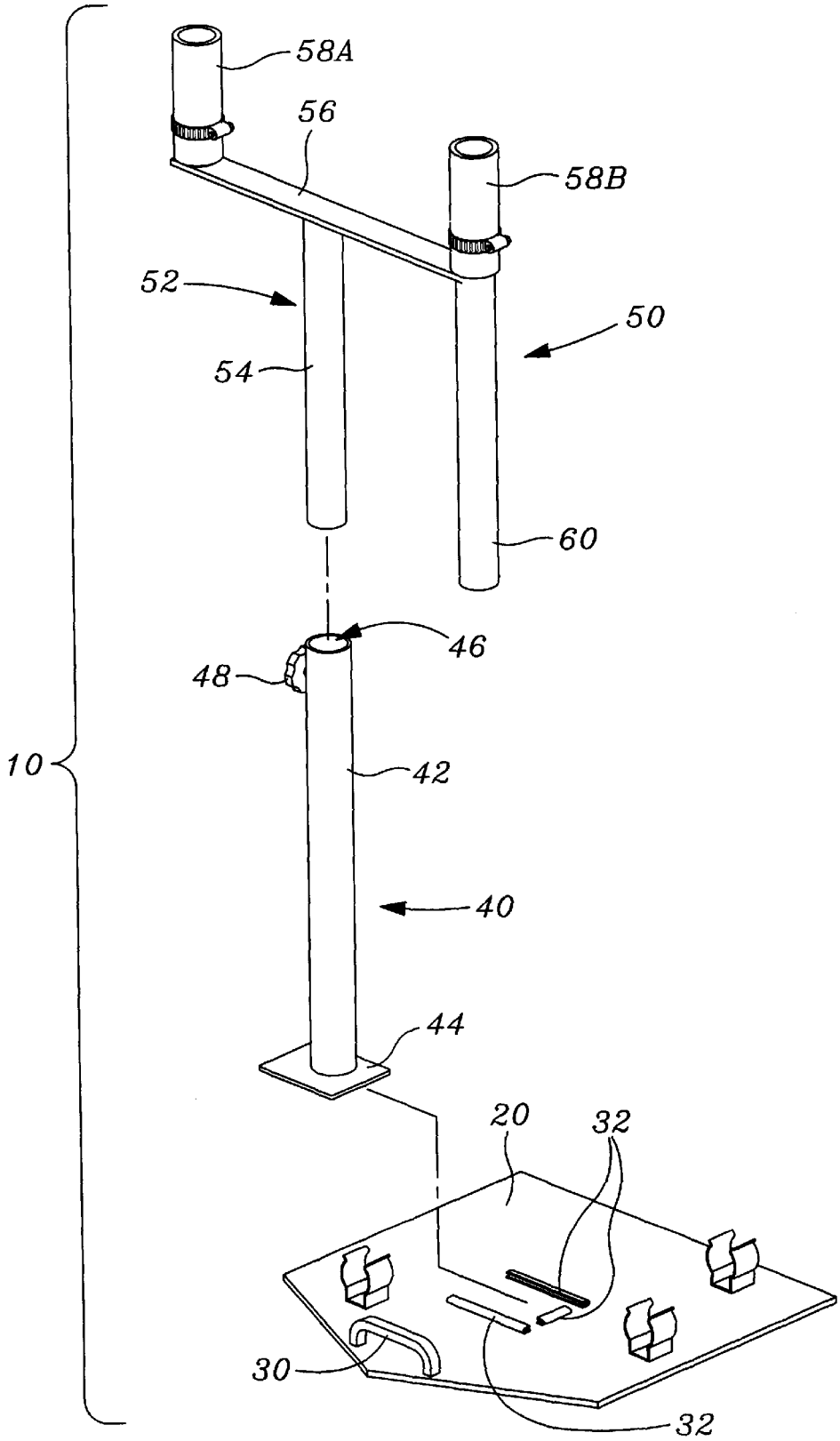
FIG. 1 is an exploded perspective view of the preferred embodiment of the present invention showing how the invention is assembled for use in batting practice.

The above described drawing figures illustrate the invention, a baseball support device 10 for holding a baseball 12 in position for batting practice. The device has a base 20 capable of resting upon a ground surface. The base 20 is preferably of a size and shape corresponding to the standard or regulation baseball home plate and provides a planar downwardly facing surface 22 for contact with a baseball home plate or the ground surface. This configuration allows the base 20 to be positionable in contact with, and over the home plate, and is representative of the home plate during batting practice. The base 20 is preferably made of a heavy material such as steel to provide durability as well as a solid foundation for the rest of the baseball support device 10 so that it does not have a tendency to tip over during use. The base 20 also includes an upfacing surface 24 which has an engagement lip 32, an attachment means 26, and a handle 30. The engagement lip 32 and the attachment means 26 are described in more detail below.

Figure 3:
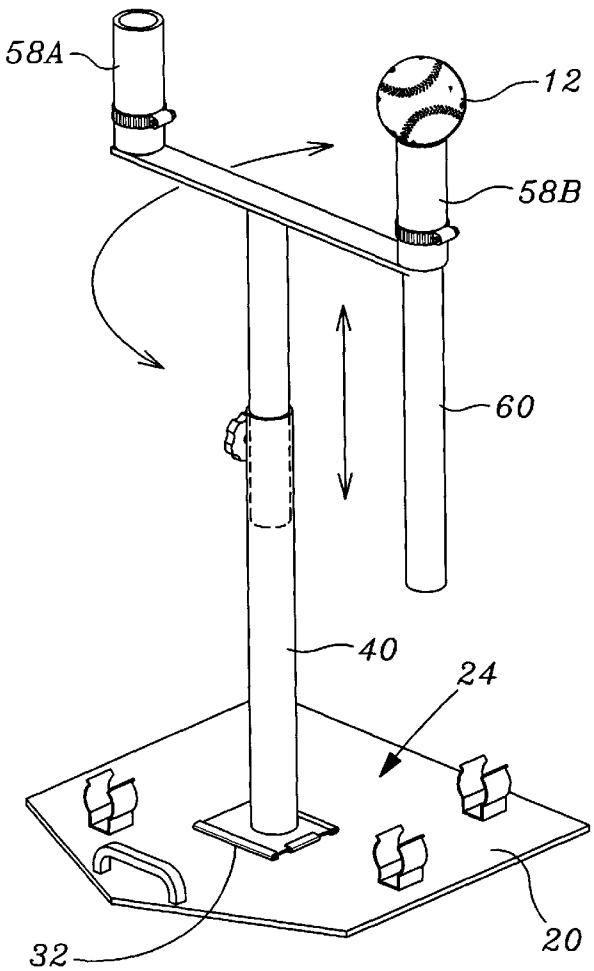
FIG. 3 is a perspective view thereof with the first support strut engaged with the second support strut, with arrows showing how the apparatus can be adjusted to hold one baseball in various positions relative to the batter, thereby representing conditions associated with known pitches.
Figure 2:
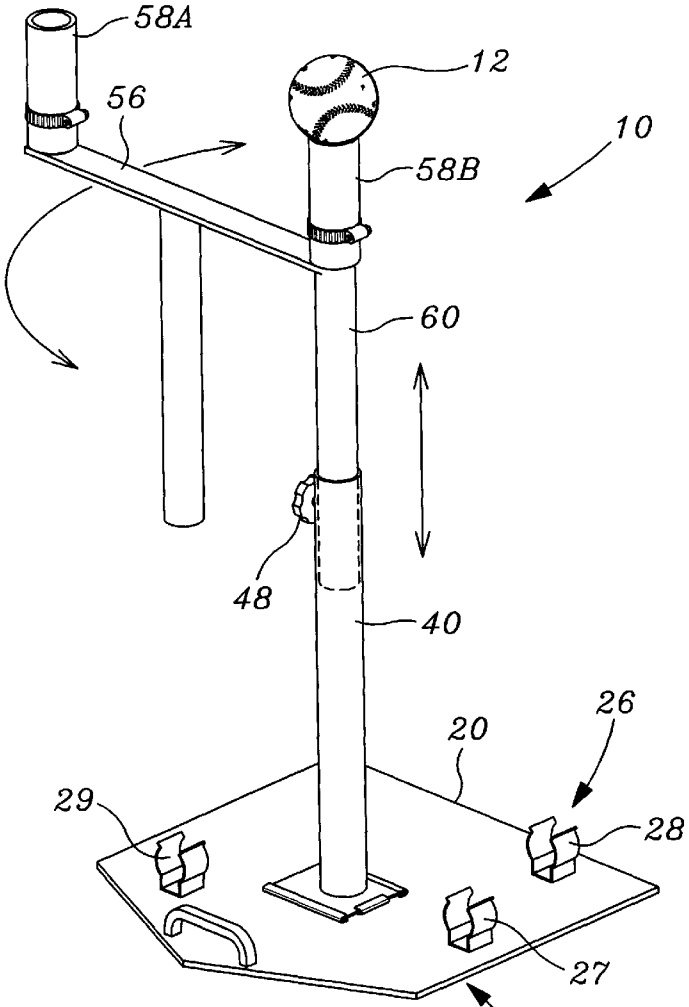
FIG. 2 is a perspective view thereof showing the first support strut engaged with the third support strut and one baseball mounted on one of two ball holding means.
Figure 4:
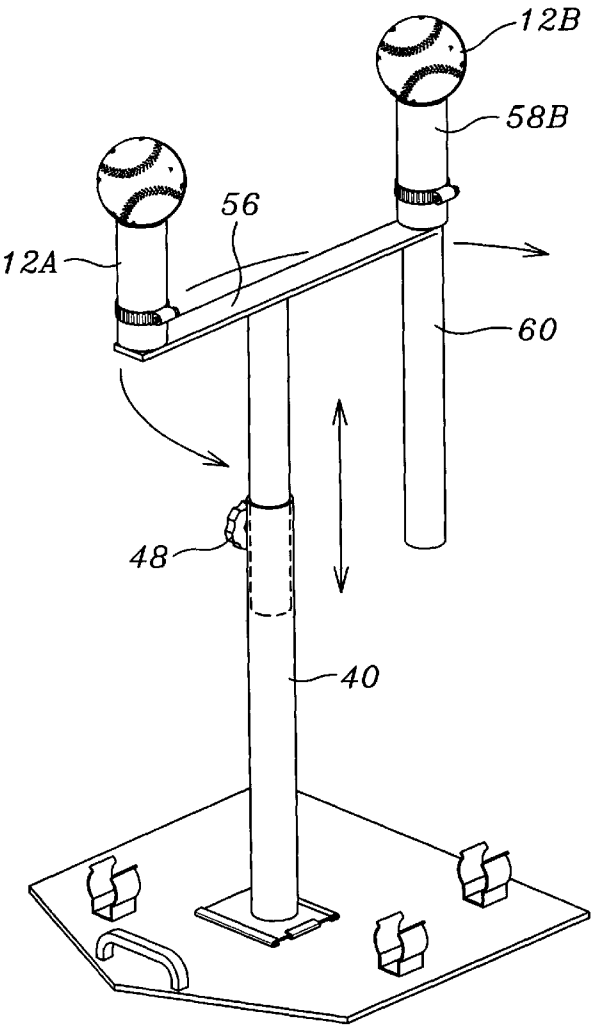
FIG. 4 is a perspective view thereof showing the first support strut engaged with the second support strut, and wherein two baseballs are supported along the path of the batter's swing, enabling the batter to practice various batting techniques.

The baseball support device 10 further includes a first support strut 40 engagable with the base means 20 and extending upwardly in a vertical attitude. The first support strut 40 is preferably a relatively larger tube 42 made of steel, the larger tube 42 having a diameter of approximately 1.5 inches. In its preferred embodiment, the first support strut 40 has a base plate 44 at its lower end and an open mouth 46 at the upper end of the larger tube 42. The first support strut 40 further provides a locking screw 48 threadably engaged through the larger tube 42 near the open mouth 46 of the larger tube 42. When the baseball support device 10 is assembled for use, as shown in FIGS. 2–4, the base plate 44 is slidably engaged with an engagement lip 32 on the base 20, locking the first support strut 40 in a preferred vertical attitude for use in batting practice. The engagement lip 32 preferably includes three lips which correspond to three side of a rectangle, which together act to slidably accept the base plate 44. When the baseball support device 10 is disassembled for transport or storage, the first support strut 40 is removed from the base 20 by disengaging the base plate 44 from the engagement lip 32. For portability and storage the larger tube 42 of the first support strut 40 is attached to the base 20 via the attachment means 26, preferably a first battery type clip 27.

The baseball support device 10 further includes a swing arm assembly 50 providing second and third support struts 52 and 60 and a horizontal arm 56. A first and second ball holding means 58A and 58B are attached to the horizontal arm 56 where they extend upwardly and are positioned laterally with respect to the support struts. The second support strut 52 is preferably a smaller tube 54 made of steel, the smaller tube 54 having a diameter slightly smaller than the larger tube 42. When assembled for use, as shown in FIGS. 3 and 4, the smaller tube 54 of the second support strut 52 slides into the larger tube 42 of the first support strut 40, providing a vertical sliding engagement (telescoping) with the first support strut 40, operably enabling the swing arm assembly 50 to be adjusted over a range of vertical heights above the ground surface. When the smaller tube 54 has been inserted into the larger tube 42, the smaller tube 54 can be locked into place by tightening the locking screw of the first support strut 40. The horizontal arm 56 of the swing arm assembly 50 is preferably a steel bar approximately 1 inch wide, 1/10 inch thick and about 1.5 feet long. The length of the horizontal arm 56 is important because it enables two special batting drills described in more detail below. The horizontal arm 56 is preferably integrally connected to the second support strut 52. The two ball holding means 58A and 58B are preferably each made of a flexible length of hose such as a piece of radiator hose, each having a diameter of less than the diameter of a baseball 12. A baseball 12 is then placed on top of the first and/or second ball holding means 58A and 58B. Since the horizontal arm 56 is mounted on the second support strut 52, and the second support strut 52 is adjustably attached to the first support strut 40, it is possible to position the baseball over a wide range of positions relative to the base 20. The different training possibilities enabled by the baseball support device 10 are discussed in more detail below.

In its preferred embodiment, a third support strut 60 extends vertically downwardly from the second baseball support means 58B. The third support strut 60 is preferably a steel tube similar to the smaller tube 54 of the second support strut 52. Like the smaller tube 54 of the second support strut 52, as shown in FIG. 2, the third support strut 60 is rotationally engagable with the first support strut 40 and vertically adjustable therein for positioning the horizontal arm 56 vertically. This allows the user to mount the horizontal arm 56 on two different support struts 52 and 60, further expanding the range of positions in which a user can position a baseball 12 for practice. This further expands the versatility of the invention.

Figure 5:
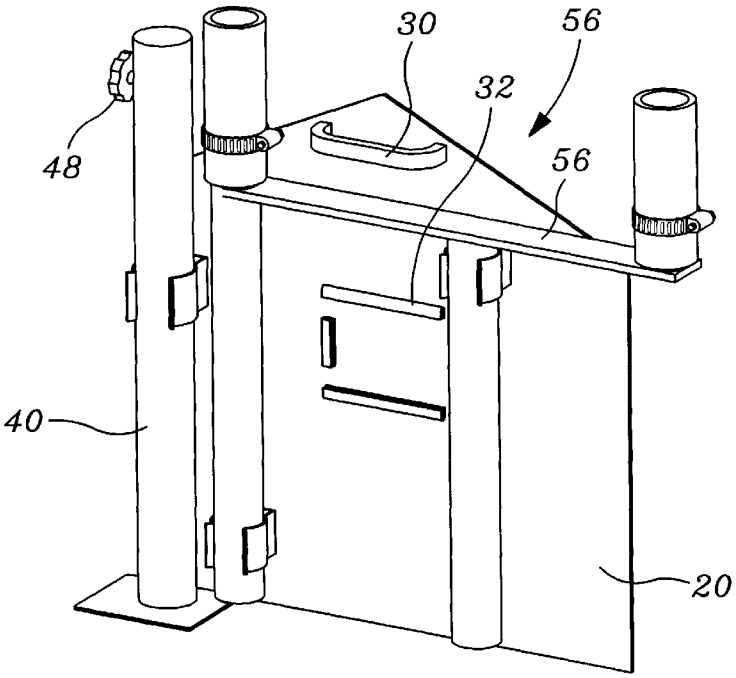
FIG. 5 is a perspective view of the invention in its collapsed and portable configuration.

As shown in FIG. 5 and as discussed above, the base 20 also includes an upfacing surface 24 which provides the attachment means 26. The first support strut 40 and the swing arm assembly 50 are engagable with the attachment means 26 of the base 20 for compactly storing the device. The attachment means 27 is preferably a first, second and third battery type clips 27, 28 and 29. When the invention is disassembled for travel or storage, the first support strut 40 is removably attached to the first battery type clip 27. The second and third support struts 52 and 60 are removably attached to the base 20 with the second and third battery type clips 28 and 29. As described above, the upfacing surface 24 of the base 20 preferably further includes a handle 30 for carrying the disassembled baseball support device 10. The handle 30 is preferably a common drawer-pull type handle. The handle 30 is preferably integrally attached to the base means 20.

The combination of the first support strut 40 and the swing arm assembly 50 enable batters to position a baseball 12 in many different locations relative to the base 20. This enables batters to practice swinging at simulated pitches that are low and inside, high and outside, and any other combination of possible pitching locations. In particular, the configuration shown in FIG. 3 is such as to position baseballs that would be in the strike zone of the home plate, while the configuration shown in FIG. 2 is such as to position baseballs that would be outside the strike zone. The length of the horizontal arm 56 and the positions of the ball holding means 58A,B on the arm 56 determine where the ball 12 may be positioned relative to the home plate. This invention also enables special technical training to improve a swing. Specifically, the swing arm assembly 50 can be adjusted to hold two baseballs 12A and 12B along the path of the batter's swing as shown in FIG. 4. The batter swings to hit the first baseball 12A without disturbing the second baseball 12B. When the batter swings at the first baseball 12A and misses the second baseball 12B, (known as "batting up") this ensures that the batter's swing curves upward in a proper arc after hitting the first baseball 12A. When the batter swings at the second baseball 12B and tries to avoid the first baseball 12A (known as "batting down"), his swing must arc downward in proper form to avoid hitting the first baseball 12A. The special structure of the swing arm assembly 50 of this invention thereby enables batters to practice special technical skills that are not possible with prior art inventions.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A baseball support device for holding a baseball in position for batting practice, the device comprising:

a base capable of resting upon a ground surface;

a first support strut engagable with the base and extending upwardly in a vertical attitude;

a swing arm assembly providing a second support strut in vertical sliding engagement with the first support strut, operably enabling the swing arm assembly to be adjusted over a range of vertical heights above the ground surface;

the second support strut providing a horizontal arm terminating with a ball holding means positioned laterally from the support struts, the horizontal arm being rotatable about the first and second support struts to position the baseball relative to the base;

the horizontal arm providing a second ball holding means positioned laterally to the first ball holding means, and a third support strut extending vertically downwardly from the second ball holding means, the third support strut being rotationally engagable with the first support strut and vertically adjustable therein for positioning the horizontal arm vertically.

2. The baseball support device of claim 1 wherein the base provides a planar downwardly facing surface for contact with a baseball home plate, the base being of a size and shape corresponding to the baseball home plate so that the base is positionable in contact with, and over the home plate and is representative thereof during batting training.

3. The baseball support device of claim 1 further providing attachment means on an upfacing surface of the base, first support strut and the swing arm assembly being engagable with the base attachment means for compactly storing the device.

4. The baseball support device of claim 3 further including a handle for carrying the device.

5. The baseball support device of claim 1 wherein the ball holding means is at least one flexible length of hose.

* * * * *